US010209638B2

(12) United States Patent
Okada

(10) Patent No.: US 10,209,638 B2
(45) Date of Patent: Feb. 19, 2019

(54) ELECTROPHOTOGRAPHIC PHOTOSENSITIVE MEMBER

(71) Applicant: KYOCERA Document Solutions Inc., Osaka (JP)

(72) Inventor: Hideki Okada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/972,520

(22) Filed: May 7, 2018

(65) Prior Publication Data

US 2018/0335710 A1 Nov. 22, 2018

(30) Foreign Application Priority Data

May 17, 2017 (JP) ..... 2017-098170

(51) Int. Cl.

| | |
|---|---|
| ***G03G 5/06*** | (2006.01) |
| *G03G 5/05* | (2006.01) |
| *G03G 5/10* | (2006.01) |

(52) U.S. Cl.

CPC ..... *G03G 5/0653* (2013.01); *G03G 5/0614* (2013.01); *G03G 5/0696* (2013.01); *G03G 5/0564* (2013.01); *G03G 5/102* (2013.01); *G03G 2215/00957* (2013.01)

(58) Field of Classification Search

CPC .. G03G 5/0627; G03G 5/0629; G03G 5/0644; G03G 5/0614; G03G 5/0653

USPC ..... 430/58.15

See application file for complete search history.

(56) References Cited

U.S. PATENT DOCUMENTS 6,383,698 B1 * 5/2002 Okada ..... G03G 5/047 430/56

7,291,429 B2 11/2007 Kim et al.

2005/0112482 A1 5/2005 Kim et al.

FOREIGN PATENT DOCUMENTS

JP 2005-154444 A 6/2005

OTHER PUBLICATIONS

Huang et al., "First-Principles Investigation of the Electronic and Conducting Properties of Oligothienoacenes and their Derivatives," The Chemistry—An Asian Journal (2012), 7(5), pp. 1032-1040. (Year: 2012).*

* cited by examiner

*Primary Examiner* — Janis L Dote

(74) *Attorney, Agent, or Firm* — Studebaker & Brackett PC

(57) ABSTRACT

An electrophotographic photosensitive member includes a conductive substrate and a photosensitive layer. The photosensitive layer has a single-layer structure and contains a charge generating material and a compound represented by general formula (1) shown below. In the general formula (1), $R^1$ and $R^2$ each represent, independently of each other: an alkyl group having 1 to 12 carbon atoms and optionally substituted by an alkoxy group having 1 to 6 carbon atoms or an alkoxycarbonyl group having 2 to 6 carbon atoms; an aryl group having 6 to 14 carbon atoms and optionally substituted by an alkyl group having 1 to 6 carbon atoms; an aralkyl group having 7 to 20 carbon atoms; or a cycloalkyl group having 3 to 10 carbon atoms. X represents —S— or —$SO_2$—.

(I)

8 Claims, 1 Drawing Sheet

ELECTROPHOTOGRAPHIC PHOTOSENSITIVE MEMBER

INCORPORATION BY REFERENCE

The present application claims priority under 35 U.S.C. § 119 to Japanese Patent Application No. 2017-098170, filed on May 17, 2017. The contents of this application are incorporated herein by reference in their entirety.

BACKGROUND

The present disclosure relates to an electrophotographic photosensitive member.

An electrophotographic photosensitive member is used as an image bearing member in an electrophotographic image forming apparatus (for example, a printer or a multifunction peripheral). Examples of the electrophotographic photosensitive member include a multi-layer electrophotographic photosensitive member and a single-layer electrophotographic photosensitive member. The multi-layer electrophotographic photosensitive member includes a photosensitive layer including a charge generating layer having a charge generating function and a charge transport layer having a charge transport function. The single-layer electrophotographic photosensitive member includes a photosensitive layer having the charge generating function and the charge transport function.

In an example of the electrophotographic photosensitive member, a compound represented by chemical formula (E-1) shown below is contained in the photosensitive layer.

(E-1)

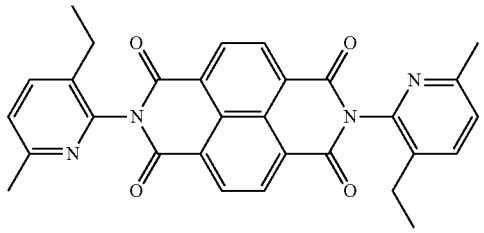

SUMMARY

An electrophotographic photosensitive member according to the present disclosure includes a conductive substrate and a photosensitive layer. The photosensitive layer has a single-layer structure and contains a charge generating material and a compound represented by a general formula (1) shown below.

(1)

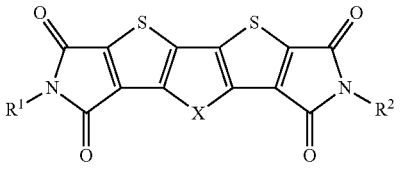

In the general formula (1), $R^1$ and $R^2$ each represent, independently of each other: an alkyl group having a carbon number of at least 1 and no greater than 12 and optionally substituted by an alkoxy group having a carbon number of at least 1 and no greater than 6 or an alkoxycarbonyl group having a carbon number of at least 2 and no greater than 6; an aryl group having a carbon number of at least 6 and no greater than 14 and optionally substituted by an alkyl group having a carbon number of at least 1 and no greater than 6; an aralkyl group having a carbon number of at least 7 and no greater than 20; or a cycloalkyl group having a carbon number of at least 3 and no greater than 10. X represents —S— or —$SO_2$—.

DETAILED DESCRIPTION

Figure 1:
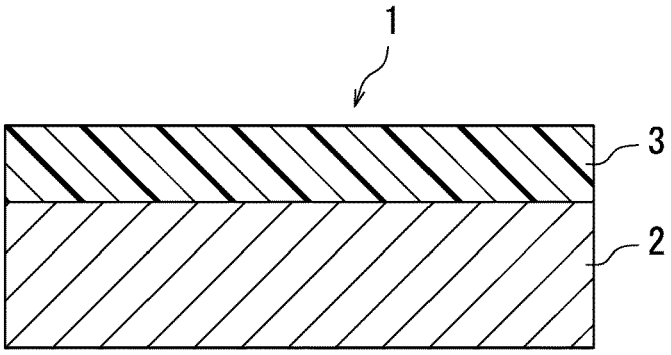
FIG. 1 is a partial cross-sectional view illustrating an example of an electrophotographic photosensitive member according to the present disclosure.

The following describes an embodiment of the present disclosure in detail. However, the present disclosure is by no means limited to the following embodiment and may be practiced with alterations appropriately made within a scope of the object of the present disclosure. Although some overlapping explanations will be omitted as appropriate, such omission does not limit the gist of the present disclosure. In the following description, the term "-based" is appended to the name of a chemical compound to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof.

In the following description, an alkyl group having a carbon number of at least 1 and no greater than 12, an alkyl group having a carbon number of at least 1 and no greater than 6, an alkyl group having a carbon number of at least 1 and no greater than 4, an alkoxy group having a carbon number of at least 1 and no greater than 6, an alkoxycarbonyl group having a carbon number of at least 2 and no greater than 6, an aryl group having a carbon number of at least 6 and no greater than 14, an aralkyl group having a carbon number of at least 7 and no greater than 20, and a cycloalkyl group having a carbon number of at least 3 and no greater than 10 mean the followings.

The alkyl group having a carbon number of at least 1 and no greater than 12 is an unsubstituted straight chain or branched chain alkyl group. Examples of the alkyl group having a carbon number of at least 1 and no greater than 12 include methyl group, ethyl group, n-propyl group, isopropyl group, n-butyl group, isobutyl group, s-butyl group, t-butyl group, pentyl group, isopentyl group, neopentyl group, n-hexyl group, n-heptyl group, n-octyl group, 2-ethylhexyl group, n-nonyl group, n-decyl group, n-undecyl group, and n-dodecyl group.

The alkyl group having a carbon number of at least 1 and no greater than 6 is an unsubstituted straight chain or branched chain alkyl group. Examples of the alkyl group having a carbon number of at least 1 and no greater than 6 include methyl group, ethyl group, n-propyl group, isopropyl group, n-butyl group, isobutyl group, s-butyl group, t-butyl group, pentyl group, isopentyl group, neopentyl group, and n-hexyl group.

The alkyl group having a carbon number of at least 1 and no greater than 4 is an unsubstituted straight chain or branched chain alkyl group. Examples of the alkyl group having a carbon number of at least 1 and no greater than 4 include methyl group, ethyl group, n-propyl group, isopropyl group, n-butyl group, isobutyl group, s-butyl group, and t-butyl group.

The alkoxy group having a carbon number of at least 1 and no greater than 6 is an unsubstituted straight chain or branched chain alkoxy group. Examples of the alkoxy group having a carbon number of at least 1 and no greater than 6 include methoxy group, ethoxy group, n-propoxy group, isopropoxy group, n-butoxy group, isobutoxy group, s-butoxy group, t-butoxy group, pentyloxy group, isopentyloxy group, neopentyloxy group, and hexyloxy group.

The alkoxycarbonyl group having a carbon number of at least 2 and no greater than 6 is an unsubstituted straight chain or branched chain alkoxycarbonyl group. Examples of the alkoxycarbonyl group having a carbon number of at least 2 and no greater than 6 include methoxycarbonyl group, ethoxycarbonyl group, n-propoxycarbonyl group, isopropoxycarbonyl group, n-butoxycarbonyl group, s-butoxycarbonyl group, t-butoxycarbonyl group, and pentyloxycarbonyl group.

The aryl group having a carbon number of at least 6 and no greater than 14 is an unsubstituted aryl group. Examples of the aryl group having a carbon number of at least 6 and no greater than 14 include unsubstituted monocyclic aromatic hydrocarbon group having a carbon number of at least 6 and no greater than 14, unsubstituted condensed bicyclic aromatic hydrocarbon group having a carbon number of at least 6 and no greater than 14, and unsubstituted condensed tricyclic aromatic hydrocarbon group having a carbon number of at least 6 and no greater than 14. More specific examples of the aryl group having a carbon number of at least 6 and no greater than 14 include phenyl group, naphthyl group, anthryl group, and phenanthryl group.

The aralkyl group having a carbon number of at least 7 and no greater than 20 is a substituted alkyl group having a carbon number of at least 1 and no greater than 6 in which a hydrogen atom is substituted by an aryl group having a carbon number of at least 6 and no greater than 14. Examples of the aralkyl group having a carbon number of at least 7 and no greater than 20 include phenylmethyl group (benzyl group), 2-phenylethyl group (phenethyl group), 1-phenylethyl group, 3-phenylpropyl group, 4-phenylbutyl group, naphthylmethyl group, anthrylmethyl group, and phenanthrylmethyl group.

The cycloalkyl group having a carbon number of at least 3 and no greater than 10 is an unsubstituted cycloalkyl group. Examples of the cycloalkyl group having a carbon number of at least 3 and no greater than 10 include cyclopropyl group, cyclobutyl group, cyclopentyl group, cyclohexyl group, cycloheptyl group, cyclooctyl group, cyclononyl group, and cyclodecyl group.

In the following description, "optionally substituted by an alkoxy group having a carbon number of at least 1 and no greater than 6" means some or all of hydrogen atoms included in an organic group may each be substituted by an alkoxy group having a carbon number of at least 1 and no greater than 6. Also, phrases "optionally substituted by an alkoxycarbonyl group having a carbon number of at least 2 and no greater than 6" and "optionally substituted by an alkyl group having a carbon number of at least 1 and no greater than 6" have meanings similar to the above.

Structure of Photosensitive Member

Figure 2:
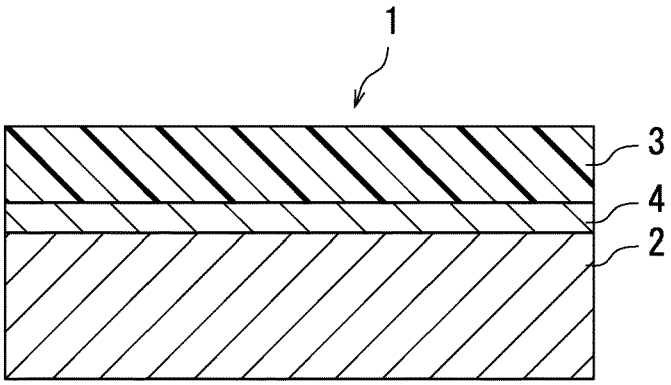
FIG. 2 is a partial cross-sectional view illustrating another example of the electrophotographic photosensitive member according to the present disclosure.
Figure 3:
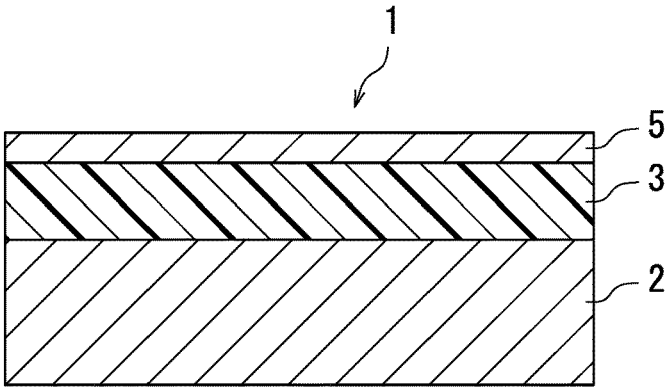
FIG. 3 is a partial cross-sectional view illustrating still another example of the electrophotographic photosensitive member according to the present disclosure.

The following describes a structure of an electrophotographic photosensitive member (hereinafter may be referred to as a photosensitive member) according to an embodiment of the present disclosure. FIGS. 1, 2, and 3 are each a partial cross-sectional view illustrating an example of a structure of a photosensitive member 1 according to the embodiment of the present disclosure. As illustrated in FIG. 1, the photosensitive member 1 includes a conductive substrate 2 and a photosensitive layer 3. The photosensitive layer 3 has a single-layer structure. As illustrated in FIG. 1, the photosensitive layer 3 may be disposed directly on the conductive substrate 2. Alternatively, the photosensitive member 1 may include for example the conductive substrate 2, an intermediate layer 4 (for example, an undercoat layer), and the photosensitive layer 3 as illustrated in FIG. 2. In the example illustrated in FIG. 2, the photosensitive layer 3 is disposed indirectly on the conductive substrate 2 with the intermediate layer 4 therebetween. Alternatively, the photosensitive member 1 may include a protective layer 5 as a topmost layer as illustrated in FIG. 3.

The shape of the conductive substrate 2 is selected appropriately according to a configuration of an image forming apparatus in which the photosensitive member 1 is mounted. Examples of the shape of the conductive substrate 2 include a sheet-like shape and a drum-like shape. The thickness of the conductive substrate 2 is selected appropriately according to the shape of the conductive substrate 2.

The thickness of the photosensitive layer 3 is not particularly limited so long as the photosensitive layer can sufficiently function as the photosensitive layer. The thickness of the photosensitive layer 3 is preferably at least 5 μm and no greater than 100 μm, and more preferably at least 10 μm and no greater than 50 μm.

The photosensitive layer 3 contains a charge generating material and a compound represented by general formula (1) shown below (hereinafter may be referred to as a compound (1)). The photosensitive layer 3 may further contain either or both of a hole transport material and a binder resin. Also, the photosensitive layer 3 may contain various additives as necessary. In the photosensitive member 1, which is a single-layer photosensitive member, the charge generating material, the compound (1), and optionally added components (for example, the hole transport material, the binder resin, and the additives) are contained in the same photosensitive layer 3.

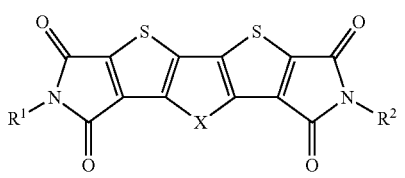

(1)

In general formula (1), $R^1$ and $R^2$ each represent, independently of each other: an alkyl group having a carbon number of at least 1 and no greater than 12 and optionally substituted by an alkoxy group having a carbon number of at least 1 and no greater than 6 or an alkoxycarbonyl group having a carbon number of at least 2 and no greater than 6;

an aryl group having a carbon number of at least 6 and no greater than 14 and optionally substituted by an alkyl group having a carbon number of at least 1 and no greater than 6; an aralkyl group having a carbon number of at least 7 and no greater than 20; or a cycloalkyl group having a carbon number of at least 3 and no greater than 10. X represents —S— or —$SO_2$—.

The photosensitive member 1 can have improved sensitivity characteristics as a result of the photosensitive layer 3 containing the compound (1). Reasons for this are inferred as follows.

The compound (1) has a π-conjugated structure of a relatively high degree of planeness. Due to this π-conjugated structure of a relatively high degree of planeness, the compound (1) tends to exhibit high carrier (electron) acceptability. Also, as a result of the compound (1) having the π-conjugated structure of a relatively high degree of planeness, π-conjugated systems of plural molecules of the compound (1) tend to overlap one another. Therefore, a migration distance of the carrier (electron) among the molecules of the compound (1) becomes relatively small. As a result, the compound (1) tends to exhibit high carrier (electron) transport ability. That is, it is thought that the photosensitive member 1 can have improved sensitivity characteristics since the photosensitive member 1 includes the photosensitive layer 3 containing the compound (1) that tends to exhibit high carrier (electron) acceptability and high carrier (electron) transport ability.

Through the above, the structure of the photosensitive member 1 has been described with reference to FIGS. 1 to 3.

Elements of Photosensitive Member

The following describes elements of the photosensitive member according to the embodiment of the present disclosure.

Conductive Substrate

No specific limitation is placed on the conductive substrate so long as the conductive substrate can be used in the photosensitive member. It is only required that at least a surface portion of the conductive substrate is made from an electrically conductive material. An example of the conductive substrate is made from an electrically conductive material. Another example of the conductive substrate is coated with an electrically conductive material. Examples of electrically conductive materials include aluminum, iron, copper, tin, platinum, silver, vanadium, molybdenum, chromium, cadmium, titanium, nickel, palladium, indium, stainless steel, and brass. In the present embodiment, any of the above-listed electrically conductive materials may be used alone or two or more of the above-listed electrically conductive materials may be used in combination (for example, as an alloy). Among the above-listed electrically conductive materials, aluminum and aluminum alloys are preferable in terms of favorable charge mobility from the photosensitive layer to the conductive substrate.

Photosensitive Layer

The photosensitive layer has a single-layer structure and contains a charge generating material and the compound (1). The photosensitive layer may further contain either or both of a hole transport material and a binder resin. Also, the photosensitive layer may contain various additives as necessary. The following describes the compound (1), a method for synthesizing the same, and the charge generating material, as well as the optionally added hole transport material, binder resin, and additives.

Compound (1)

The compound (1) is represented by general formula (1) and contained for example as an electron transport material in the photosensitive layer. The photosensitive layer may contain only one type of the compound (1) or two or more types of the compound (1). In terms of further improvement of the sensitivity characteristics, $R^1$ and $R^2$ in general formula (1) each preferably represent, independently of each other: an alkyl group having a carbon number of at least 1 and no greater than 12 and substituted by an alkoxy group having a carbon number of at least 1 and no greater than 6 or an alkoxycarbonyl group having a carbon number of at least 2 and no greater than 6; or an aryl group having a carbon number of at least 6 and no greater than 14 and substituted by an alkyl group having a carbon number of at least 1 and no greater than 6. More preferably, $R^1$ and $R^2$ in general formula (1) each represent, independently of each other: an alkyl group having a carbon number of at least 1 and no greater than 6 and substituted by an alkoxy group having a carbon number of at least 1 and no greater than 6 or an alkoxycarbonyl group having a carbon number of at least 2 and no greater than 6; or a phenyl group substituted by an alkyl group having a carbon number of at least 1 and no greater than 4. Still more preferably, $R^1$ and $R^2$ in general formula (1) each represent, independently of each other: an alkyl group having a carbon number of at least 1 and no greater than 6 and substituted by an ethoxy group or a methoxycarbonyl group; or a phenyl group substituted by alkyl groups each having a carbon number of at least 1 and no greater than 4. In terms of still further improvement of the sensitivity characteristics, at least one of $R^1$ and $R^2$ preferably represents an alkyl group having a carbon number of at least 1 and no greater than 12 and substituted by an alkoxy group having a carbon number of at least 1 and no greater than 6 or an alkoxycarbonyl group having a carbon number of at least 2 and no greater than 6, more preferably represents an alkyl group having a carbon number of at least 1 and no greater than 6 and substituted by an alkoxy group having a carbon number of at least 1 and no greater than 6 or an alkoxycarbonyl group having a carbon number of at least 2 and no greater than 6, and particularly preferably represents an alkyl group having a carbon number of at least 1 and no greater than 6 and substituted by an ethoxy group or a methoxycarbonyl group.

In terms of improvement of solubility to a solvent used in preparation of an application liquid for photosensitive layer formation, it is preferable that $R^1$ and $R^2$ in general formula (1) are different from each other.

In terms of further improvement of the sensitivity characteristics, X in general formula (1) preferably represents —$SO_2$—. Note that a compound represented by general formula (1) in which X represents —S— is represented by general formula (1-A) shown below. Also, a compound represented by general formula (1) in which X represents —$SO_2$— is represented by general formula (1-B) shown below. In general formulas (1-A) and (1-B), $R^1$ and $R^2$ represent the same as $R^1$ and $R^2$ in general formula (1), respectively. In the following description, the compounds represented by general formulas (1-A) and (1-B) may be referred to as compounds (1-A) and (1-B), respectively.

(1-A)

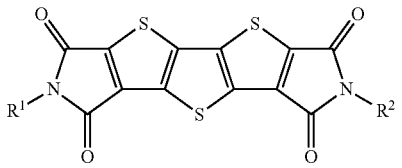

(1-B)

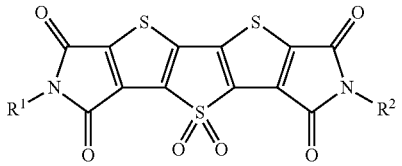

Examples of the compound (1) include compounds represented by chemical formulas (1-1), (1-2), (1-3), (1-4), (1-5), (1-6), (1-7), and (1-8) (hereinafter may be referred to as compounds (1-1), (1-2), (1-3), (1-4), (1-5), (1-6), (1-7), and (1-8), respectively).

(1-1)

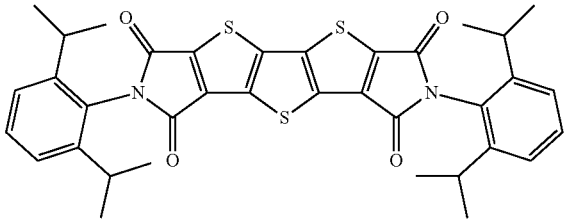

(1-2)

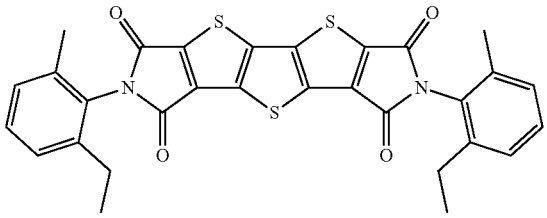

(1-3)

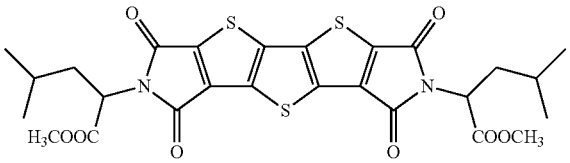

(1-4)

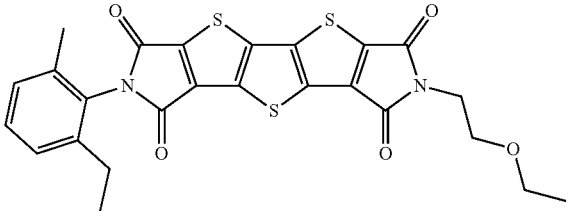

-continued (1-5)

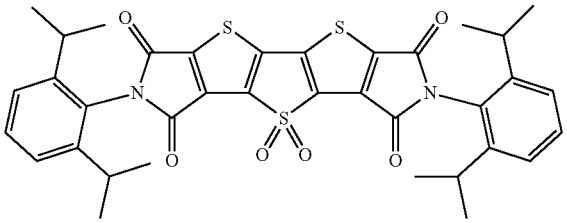

(1-6)

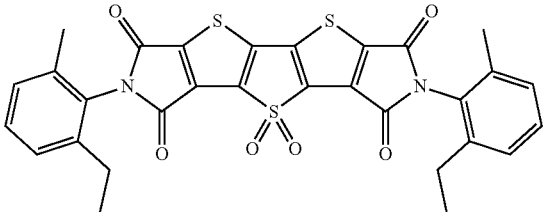

(1-7)

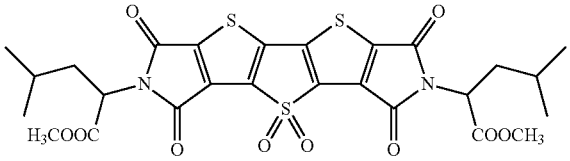

(1-8)

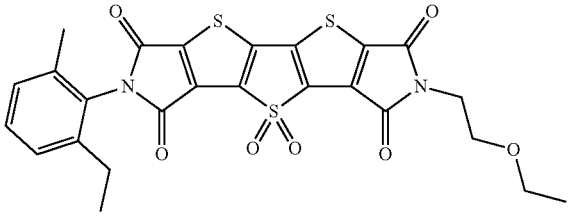

Among the compounds (1-1) to (1-8), the compounds (1-3), (1-4), (1-7), and (1-8) are preferable in terms of further improvement of the sensitivity characteristics, and the compounds (1-7) and (1-8) are more preferable.

In a configuration in which the compound (1) is contained as the electron transport material in the photosensitive layer, the amount of the compound (1) is preferably at least 5 parts by mass and no greater than 100 parts by mass relative to 100 parts by mass of a binder resin contained for example in the photosensitive layer, more preferably at least 10 parts by mass and no greater than 80 parts by mass, and particularly preferably at least 30 parts by mass and no greater than 60 parts by mass.

In a configuration in which the compound (1) is contained as the electron transport material in the photosensitive layer, the photosensitive layer may further contain an additional electron transport material in addition to the compound (1). Examples of the additional electron transport material include electron transport materials having a structure different from that of the compound (1) among the following compounds: quinone-based compounds, diimide-based compounds, hydrazone-based compounds, malononitrile-based compounds, thiopyran-based compounds, trinitrothioxanthone-based compounds, 3,4,5,7-tetranitro-9-fluorenone-based compounds, dinitroanthracene-basead compounds, dinitroacridine-based compounds, tetracyanoethylene, 2,4,8-trinitrothioxanthone, dinitrobenzene, dinitroacridine, succinic anhydride, maleic anhydride, and dibromomaleic anhydride. The amount of the compound (1) relative to a total mass of the electron transport material(s) is preferably at least 80% by mass, more preferably at least 90% by mass, and particularly preferably 100% by mass.

Synthesis of Compound (1)

In synthesis of the compound (1-A) as the compound (1), the compound (1-A) can be synthesized for example by reactions represented by the following reaction formulas (R1) and (R2) (hereinafter may be referred to as reactions (R1) and (R2), respectively) or a method in accordance therewith.

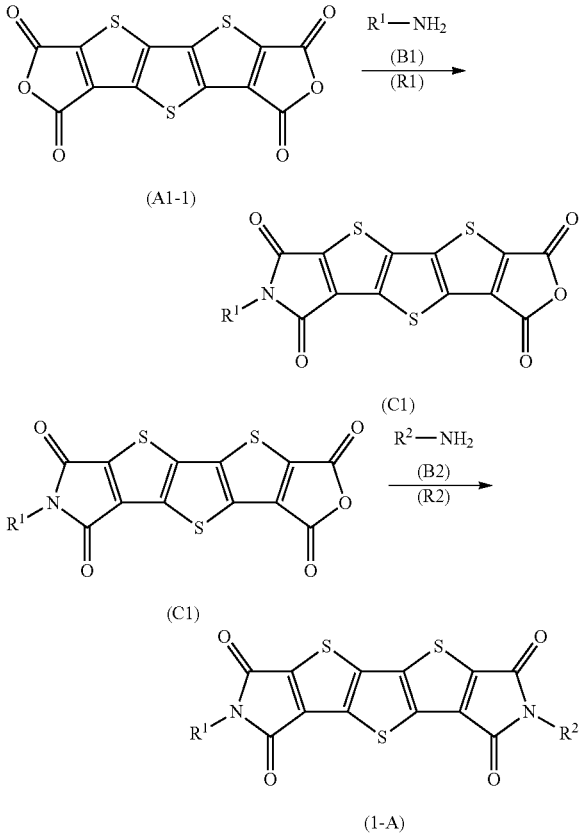

In the reaction formula (R1), $R^1$ represents the same as $R^1$ in general formula (1). In the reaction formula (R2), $R^1$ and $R^2$ represent the same as $R^1$ and $R^2$ in general formula (1), respectively.

In the reaction (R1), 1 mol equivalent of a compound represented by chemical formula (A1-1) (hereinafter may be referred to as a compound (A1-1)) and 1 mol equivalent of a compound represented by general formula (B1) (hereinafter may be referred to as a compound (B1)) are caused to react with each other to yield 1 mol equivalent of a compound represented by general formula (C1) (hereinafter may be referred to as a compound (C1)). The compound (C1) is an intermediate product. In the reaction (R1), at least 1 mol and no greater than 4 mol of the compound (B1) is preferably added relative to 1 mol of the compound (A1-1). The reaction temperature of the reaction (R1) is preferably at least 50° C. and no higher than 150° C. The reaction time of the reaction (R1) is preferably at least 1 hour and no longer than 10 hours. The reaction (R1) can be caused in a solvent. Examples of the solvent include an acetic acid and dioxane. The reaction (R1) can be caused in the presence of an acid catalyst or a base catalyst. Examples of the acid catalyst include an acetic acid and a p-toluenesulfonic acid. The base catalyst is preferably a base of low nucleophilicity. Examples of such a base catalyst include N,N-diisopropylethylamine (Hünig's base). These catalysts may each function as a solvent.

In the reaction (R2), 1 mol equivalent of the compound (C1) and 1 mol equivalent of a compound represented by general formula (B2) (hereinafter may be referred to as a compound (B2)) are caused to react with each other to yield 1 mol equivalent of the compound (1-A). The reaction (R2) is the same as the reaction (R1) in all aspects other than that the compound (A1-1) is replaced by the compound (C1) and the compound (B1) is replaced by the compound (B2).

A reaction product obtained through the reaction (R2) is purified as necessary to isolate the target compound (1-A). A known method such as crystallization or silica gel chromatography is appropriately employed as a purification method. Examples of solvents used for purification include chloroform.

Note that when the compound (B1) and the compound (B2) in the above-described reactions are the same compound, the reaction (R2) can be omitted. In this case, the target compound (1-A) can be yielded through a reaction between 1 mol equivalent of the compound (A1-1) and 2 mol equivalents of the compound (B1).

In synthesis of the compound (1-B) as the compound (1), the compound (1-B) can be synthesized by a reaction represented by the following reaction formula (R3) (hereinafter may be referred to as a reaction (R3)) or a method in accordance therewith using the compound (1-A) obtained through the above-described reactions as a starting material.

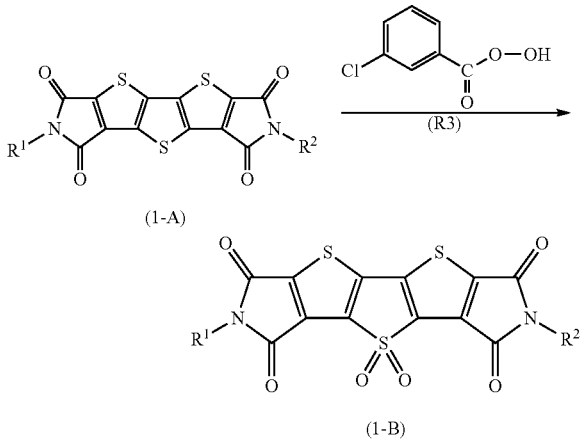

In the reaction (R3), the compound (1-A) and an m-chloroperbenzoic acid that is an oxidant are caused to react with each other to yield the compound (1-B). At least 1 mol and no greater than 50 mol of the m-chloroperbenzoic acid is preferably added relative to 1 mol of the compound (1-A). The reaction temperature of the reaction (R3) is preferably at least 50° C. and no higher than 100° C. The reaction time of the reaction (R3) is preferably at least 5 hours and no longer than 30 hours.

Another oxidant may be used instead of the m-chloroperbenzoic acid in the reaction (R3). Examples of the other oxidant include silver oxide and potassium permanganate. The reaction (R3) may be caused in a solvent. Examples of the solvent include chloroform and dichloromethane, among which chloroform is preferred.

A reaction product obtained through the reaction (R3) is purified as necessary to isolate the target compound (1-B). A known method such as crystallization or silica gel chromatography is appropriately employed as a purification method. Examples of solvents used for purification include chloroform.

Charge Generating Material

No specific limitation is placed on the charge generating material so long as the charge generating material can be used for the photosensitive member. Examples of the charge generating material include phthalocyanine-based pigments, perylene-based pigments, bisazo pigments, tris-azo pigments, dithioketopyrrolopyrrole pigments, metal-free naphthalocyanine pigments, metal naphthalocyanine pigments, squaraine pigments, indigo pigments, azulenium pigments, cyanine pigments, powders of inorganic photoconductive materials (specific examples include selenium, selenium-tellurium, selenium-arsenic, cadmium sulfide, and amorphous silicon), pyrylium pigments, anthanthrone-based pigments, triphenylmethane-based pigments, threne-based pigments, toluidine-based pigments, pyrazoline-based pigments, and quinacridone-based pigments. One of the above-listed charge generating materials may be used alone or two or more of the above-listed charge generating materials may be used in combination.

Examples of the phthalocyanine-based pigments include metal-free phthalocyanine represented by chemical formula (C-1) shown below and metal phthalocyanine. Examples of the metal phthalocyanine include titanyl phthalocyanine represented by chemical formula (C-2) shown below, hydroxygallium phthalocyanine, and chlorogallium phthalocyanine. The phthalocyanine-based pigments may be crystalline or non-crystalline. No specific limitation is placed on the crystal structure of the phthalocyanine-based pigments (specific examples include α-form, β-form, X-form, Y-form, V-form, and II-form), and phthalocyanine-based pigments of various structures can be used.

(C-1)

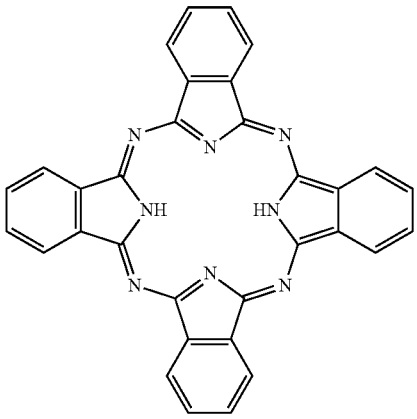

-continued (C-2)

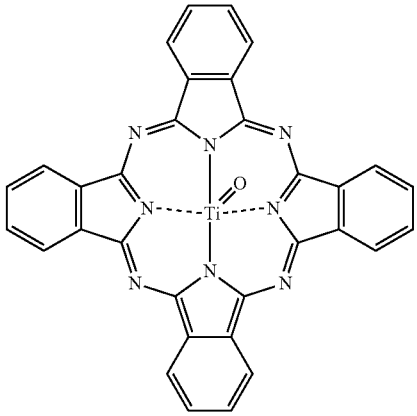

Examples of crystalline metal-free phthalocyanine include metal-free phthalocyanine having the X-form crystal structure (hereinafter may be referred to as X-form metal-free phthalocyanine). Examples of crystalline titanyl phthalocyanine include titanyl phthalocyanines having the α-form, β-form, and Y-form crystal structures (hereinafter may be referred to as α-form, β-form, and Y-form titanyl phthalocyanines, respectively). Examples of crystalline hydroxygallium phthalocyanine include hydroxygallium phthalocyanine having the V-form crystal structure.

For image forming apparatuses employing a digital optical system (for example, a laser beam printer and a facsimile machine including a light source such as a semiconductor laser), a photosensitive member having sensitivity in a wavelength range of 700 nm or longer is preferably employed. The charge generating material used for such a photosensitive member is preferably a phthalocyanine-based pigment in terms of its high quantum yield in the wavelength range of 700 nm or longer, more preferably a metal-free phthalocyanine or a titanyl phthalocyanine, and further preferably the X-form metal-free phthalocyanine or the Y-form titanyl phthalocyanine. In order to significantly improve the sensitivity characteristics in a configuration in which the compound (1) is contained as the electron transport material in the photosensitive layer, the charge generating material is preferably the Y-form titanyl phthalocyanine.

The Y-form titanyl phthalocyanine exhibits a main peak, for example, at a Bragg angle (2θ±0.2°) of 27.2° in a CuKα characteristic X-ray diffraction spectrum. The term main peak in the CuKα characteristic X-ray diffraction spectrum refers to a peak having the largest or second largest intensity in a Bragg angle (2θ±0.2°) range of at least 3° and no greater than 40°.

The following describes an example of methods for measuring the CuKα characteristic X-ray diffraction spectrum. A sample (a titanyl phthalocyanine) is loaded into a sample holder of an X-ray diffraction spectrometer (for example, "RINT (registered Japanese trademark) 1100" manufactured by Rigaku Corporation) and an X-ray diffraction spectrum is measured using a Cu X-ray tube under conditions of a tube voltage of 40 kV, a tube current of 30 mA, and a wavelength of CuKα characteristic X-rays of 1.542 Å. The measurement range (2θ) is for example at least 3° and no greater than 40° (start angle: 3°, stop angle: 40°), and the scanning rate is for example 10°/minute.

For photosensitive members adopted in image forming apparatuses using a short-wavelength laser light source (for example, a light source of laser light having a wavelength of at least 350 nm and no longer than 550 nm), an anthanthrone-based pigment is preferably used as the charge generating material.

The amount of the charge generating material is preferably at least 0.1 parts by mass and no greater than 50 parts by mass relative to 100 parts by mass of a binder resin contained for example in the photosensitive layer, more preferably at least 0.5 parts by mass and no greater than 30 parts by mass, and particularly preferably at least 0.5 parts by mass and no greater than 10 parts by mass.

Hole Transport Material

The photosensitive layer may contain a hole transport material. No specific limitation is placed on the hole transport material so long as the hole transport material can be used for the photosensitive member. Examples of the hole transport material include nitrogen-containing cyclic compounds and condensed polycyclic compounds. Examples of the nitrogen-containing cyclic compounds and the condensed polycyclic compounds include diamine compounds (specific examples include N,N,N',N'-tetraphenylphenylenediamine derivatives, N,N,N',N'-tetraphenylnaphtylenediamine derivatives, and N,N,N',N'-tetraphenylphenanthrylenediamine derivatives), oxadiazole-based compounds (specific examples include 2,5-di(4-methylaminophenyl)-1,3,4-oxadiazole), styryl compounds (specific examples include 9-(4-diethylaminostyryl)anthracene), carbazole compounds (specific examples include polyvinyl carbazole), organic polysilane compounds, pyrazoline-based compounds (specific examples include 1-phenyl-3-(p-dimethylaminophenyl)pyrazoline), hydrazone-based compounds, indole-based compounds, oxazole-based compounds, isoxazole-based compounds, thiazole-based compounds, thiadiazole-based compounds, imidazole-based compounds, pyrazole-based compounds, and triazole-based compounds. One of the above-listed hole transport materials may be used alone or two or more of the above-listed hole transport materials may be used in combination.

In order to significantly improve the sensitivity characteristics in a configuration in which the compound (1) is contained as the electron transport material in the photosensitive layer, the hole transport material is preferably a compound represented by general formula (HTM1) shown below, and more preferably a compound represented by chemical formula (HTM1-1) shown below (hereinafter may be referred to as a compound (HTM1-1)).

(HTM1)

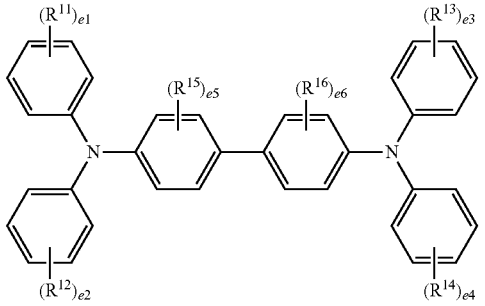

In general formula (HTM1), $R^{11}$, $R^{12}$, $R^{13}$, $R^{14}$, $R^{15}$, and $R^{16}$ each represent, independently of one another, an alkyl group having a carbon number of at least 1 and no greater than 4. Further, e1, e2, e3, and e4 each represent, independently of one another, an integer of at least 0 and no greater than 5. Also, e5 and e6 each represent, independently of each other, an integer of at least 0 and no greater than 4. When e1 represents an integer of at least 2 and no greater than 5, a plurality of chemical groups $R^{11}$ may be the same as or different from each other. When e2 represents an integer of at least 2 and no greater than 5, a plurality of chemical groups $R^{12}$ may be the same as or different from each other. When e3 represents an integer of at least 2 and no greater than 5, a plurality of chemical groups $R^{13}$ may be the same as or different from each other. When e4 represents an integer of at least 2 and no greater than 5, a plurality of chemical groups $R^{14}$ may be the same as or different from each other. When e5 represents an integer of at least 2 and no greater than 4, a plurality of chemical groups $R^{15}$ may be the same as or different from each other. When e6 represents an integer of at least 2 and no greater than 4, a plurality of chemical groups le may be the same as or different from each other.

(HTM1-1)

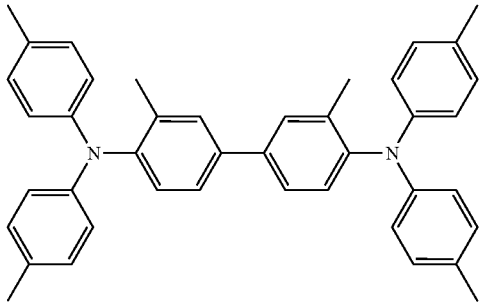

The amount of the hole transport material is preferably at least 10 parts by mass and no greater than 200 parts by mass relative to 100 parts by mass of a binder resin contained for example in the photosensitive layer, and more preferably at least 10 parts by mass and no greater than 100 parts by mass.

Binder Resin

The photosensitive layer may contain a binder resin. Examples of the binder resin include thermoplastic resins, thermosetting resins, and photocurable resins. Examples of the thermoplastic resins include polycarbonate resins, polyarylate resins, styrene-butadiene copolymers, styrene-acrylonitrile copolymers, styrene-maleic acid copolymers, acrylic acid polymers, styrene-acrylic acid copolymers, polyethylene resins, ethylene-vinyl acetate copolymers, chlorinated polyethylene resins, polyvinyl chloride resins, polypropylene resins, ionomer resins, vinyl chloride-vinyl acetate copolymers, alkyd resins, polyamide resins, urethane resins, polysulfone resins, diallyl phthalate resins, ketone resins, polyvinyl butyral resins, polyester resins, and polyether resins. Examples of the thermosetting resins include silicone resins, epoxy resins, phenolic resins, urea resins, and melamine resins. Examples of the photocurable resins include epoxy-acrylic acid-based resins (acrylic acid adducts of epoxy compounds) and urethane-acrylic acid-based copolymers (acrylic acid adducts of urethane compounds). One of the above-listed binder resins may be used alone or two or more of the above-listed binder resins may be used in combination.

Among the above-listed resins, polycarbonate resins are preferable to obtain a photosensitive layer of which workability, mechanical characteristics, optical properties, and abrasion resistance are well balanced. Examples of the polycarbonate resins include bisphenol Z polycarbonate resin having a repeating unit represented by a chemical formula shown below, bisphenol ZC polycarbonate resin, bisphenol C polycarbonate resin, and bisphenol A polycarbonate resin.

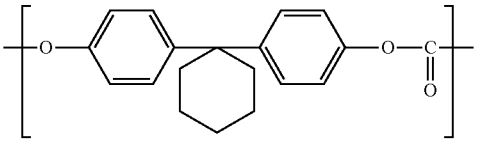

The viscosity average molecular weight of the binder resin is preferably at least 40,000, and more preferably at least 40,000 and no greater than 52,500. In a configuration in which the viscosity average molecular weight of the binder resin is at least 40,000, abrasion resistance of the photosensitive member can be easily improved. In a configuration in which the viscosity average molecular weight of the binder resin is no greater than 52,500, the binder resin readily dissolves in a solvent in formation of the photosensitive layer and an excessive increase in viscosity of the application liquid for photosensitive layer formation is prevented. As a result, formation of the photosensitive layer is facilitated.

Additives

The photosensitive layer may contain various additives as necessary. Examples of the additives include antidegradants (specific examples include antioxidants, radical scavengers, singlet quenchers, and ultraviolet absorbing agents), softeners, surface modifiers, extenders, thickeners, dispersion stabilizers, waxes, acceptors, donors, surfactants, plasticizers, sensitizers, and leveling agents. Examples of the antioxidants include hindered phenol (specific examples include di-t-butyl-p-cresol), hindered amine, paraphenylenediamine, arylalkane, hydroquinone, spirochromane, spiroindanone, derivatives of aforementioned compounds, organosulfur compounds, and organophosphorus compounds.

Combination of Materials

In order to further improve the sensitivity characteristics, it is preferable that the photosensitive layer contains the Y-form titanyl phthalocyanine as the charge generating material and at least one of the compounds (1-1), (1-2), (1-3), (1-4), (1-5), (1-6), (1-7), and (1-8). For the same reason as above, it is more preferable that the photosensitive layer contains the Y-form titanyl phthalocyanine as the charge generating material and at least one of the compounds (1-3), (1-4), (1-7), and (1-8).

Intermediate Layer

The photosensitive member according to the present embodiment may include an intermediate layer (an undercoat layer or the like). The intermediate layer contains for example inorganic particles and a resin for the intermediate layer (intermediate layer resin). The presence of the intermediate layer is thought to cause smooth flow of an electric current generated by irradiation of the photosensitive member with light, resulting in suppression of an increase in resistance while maintaining insulation to such an extent that occurrence of a leakage current can be prevented.

Examples of the inorganic particles include particles of metals (specific examples include aluminum, iron, and copper), particles of metal oxides (specific examples include titanium oxide, alumina, zirconium oxide, tin oxide, and zinc oxide), and particles of non-metal oxides (specific examples include silica). One type of the above-listed inorganic particles may be used alone or two or more types of the above-listed inorganic particles may be used in combination.

No specific limitation is placed on the intermediate layer resin so long as the intermediate layer can be formed from the intermediate layer resin. The intermediate layer may contain various additives. Examples of the additives are the same as those that may be contained in the photosensitive layer.

Method for Producing Photosensitive Member

The photosensitive member according to the present embodiment is produced for example by applying an application liquid for photosensitive layer formation (hereinafter may be referred to as an application liquid) onto a conductive substrate and drying the applied application liquid. The application liquid is prepared by dissolving or dispersing the compound (1), a charge generating material, and optionally added components (for example, a hole transport material, a binder resin, and various additives) in a solvent.

No specific limitation is placed on the solvent contained in the application liquid so long as the respective components contained in the application liquid can be dissolved or dispersed therein. Examples of the solvent include alcohols (specific examples include methanol, ethanol, isopropanol, and butanol), aliphatic hydrocarbons (specific examples include n-hexane, octane, and cyclohexane), aromatic hydrocarbons (specific examples include benzene, toluene, and xylene), halogenated hydrocarbons (specific examples include dichloromethane, dichloroethane, carbon tetrachloride, and chlorobenzene), ethers (specific examples include dimethyl ether, diethyl ether, tetrahydrofuran, ethylene glycol dimethyl ether, diethylene glycol dimethyl ether, and propylene glycol monomethyl ether), ketones (specific examples include acetone, methyl ethyl ketone, and cyclohexanone), esters (specific examples include ethyl acetate and methyl acetate), dimethyl formaldehyde, dimethyl formamide, and dimethyl sulfoxide. One of the above-listed solvents is used alone or two or more of the above-listed solvents are used in combination. In order to improve workability during production of the photosensitive member, a non-halogenated solvent (a solvent other than halogenated hydrocarbons) is preferably used.

The application liquid is prepared by mixing the respective components and dispersing the components in the solvent. Mixing or dispersion may be performed using for example a bead mill, a roll mill, a ball mill, an attritor, a paint shaker, or an ultrasonic disperser.

The application liquid may contain for example a surfactant in order to improve dispersibility of the respective components.

No specific limitation is placed on an application method of the application liquid so long as the application liquid can be uniformly applied over the conductive substrate. Examples of the application method include dip coating, spray coating, spin coating, and bar coating.

No specific limitation is placed on a drying method of the application liquid so long as at least part of the solvent contained in the application liquid can be evaporated. Specific examples of the drying method include thermal treatment (hot-air drying) using a high-temperature dryer or a reduced pressure dryer. The thermal treatment is performed for example at a temperature of at least 40° C. and no higher than 150° C. for at least 3 minutes and no longer than 120 minutes.

Either or both an intermediate layer formation process and a protective layer formation process may be included in the method for producing the photosensitive member, as necessary. A method appropriately selected from known methods is employed in each of the intermediate layer formation process and the protective layer formation process.

EXAMPLES

The following describes the present disclosure more specifically using examples. However, the present disclosure is by no means limited to the scope of the examples.

Materials used in Examples and Comparative Examples

The following hole transport material and electron transport materials were prepared as materials for forming photosensitive layers.

Hole Transport Material

The hole transport material (HTM1-1) described above was prepared as the hole transport material.

Electron Transport Material

The compounds (1-1) to (1-8) described above were prepared as the electron transport materials. Further, a compound (E-1) was also prepared. The compound (E-1) is an electron transport material represented by chemical formula (E-1) shown below.

(E-1)

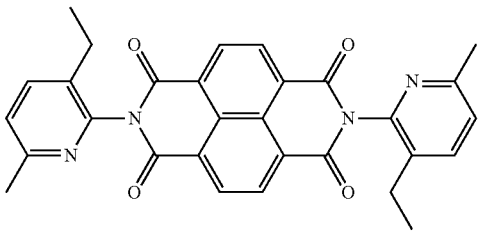

Synthesis of Compounds (1-1) to (1-8)

The compounds (1-1) to (1-8) were each synthesized by a method described below. In the following description, a percentage yield (%) is calculated in terms of the number of moles. Also, in the following description, reactions represented by reaction formulas (R10) and (R11) may be referred to as a reaction (R10) and a reaction (R11), respectively. Compounds represented by chemical formulas (B1-1), (B1-2), (B1-3), and (B2-1) may be referred to as a compound (B1-1), a compound (B1-2), a compound (B1-3), and a compound (B2-1), respectively.

Synthesis of Compound (1-1)

The compound (1-1) was synthesized by the following reaction (R10).

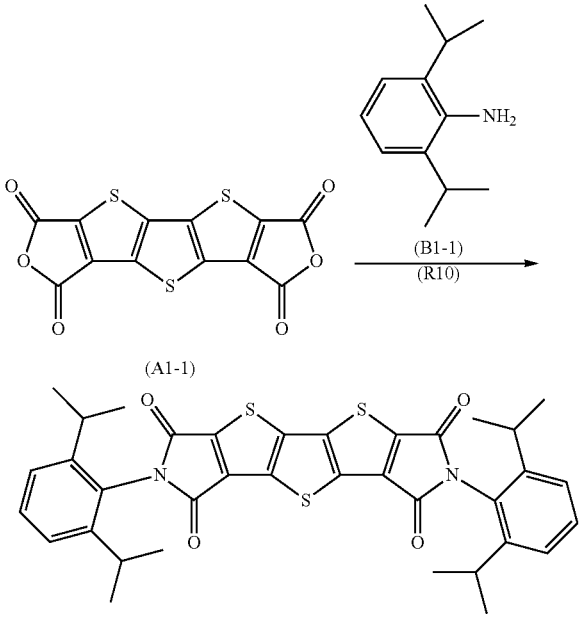

In the reaction (R10), the compound (A1-1) (0.34 g, 1.0 mmol) and an acetic acid (30 mL) were added into a flask. Then, the compound (B1-1) (1.06 g, 6.0 mmol) was added into the flask and the flask contents were stirred for three hours at 120° C. The internal temperature of the flask was adjusted to room temperature (25° C.) again and ion exchanged water was added into the flask. Then, extraction was performed using chloroform to obtain an organic phase. The organic phase was washed with ion exchanged water five times, and then dried using anhydrous sodium sulfate. Thereafter, the solvent was evaporated. The resultant residue was purified by silica gel chromatography using chloroform as a developing solvent. Through the above, the compound (1-1) was obtained. A mass yield and a percentage yield of the compound (1-1) were 0.13 g and 20%, respectively.

Synthesis of Compound (1-2)

The compound (1-2) was synthesized in the same manner as the reaction (R10) in all aspects other than that the compound (B 1-2) (0.81 g) represented by chemical formula (B1-2) shown below was used instead of the compound (B1-1) (1.06 g) in the reaction (R10). A mass yield and a percentage yield of the compound (1-2) were 0.11 g and 20%, respectively.

(B1-2)

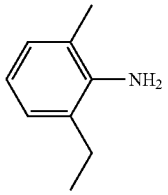

Synthesis of Compound (1-3)

The compound (1-3) was synthesized in the same manner as the reaction (R10) in all aspects other than that the compound (B1-3) (0.87 g) represented by chemical formula (B1-3) shown below was used instead of the compound (B1-1) (1.06 g) in the reaction (R10). A mass yield and a percentage yield of the compound (1-3) were 0.12 g and 20%, respectively.

(B1-3)

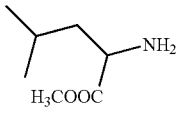

three hours at 120° C. The internal temperature of the flask was adjusted to room temperature (25° C.) again and ion exchanged water was added into the flask. Then, extraction was performed using chloroform to obtain an organic phase. The organic phase was washed with ion exchanged water five times, and then dried using anhydrous sodium sulfate. Thereafter, the solvent was evaporated. The resultant residue was purified by silica gel chromatography using chloroform as a developing solvent. Through the above, the compound (1-4) was obtained. A mass yield and a percentage yield of the compound (1-4) were 0.08 g and 15%, respectively.

(B2-1)

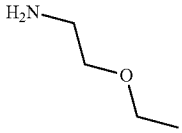

Synthesis of Compound (1-5)

The compound (1-5) was synthesized by the following reaction (R11).

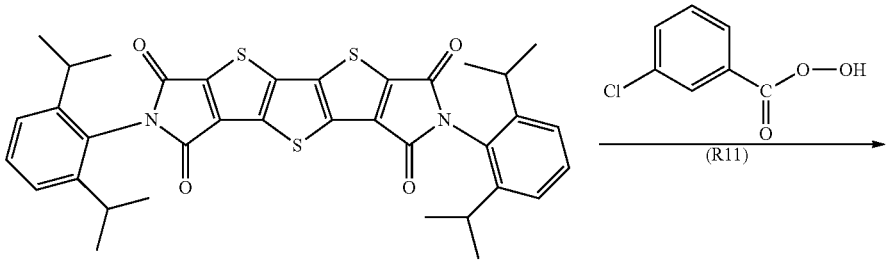

(1-1)

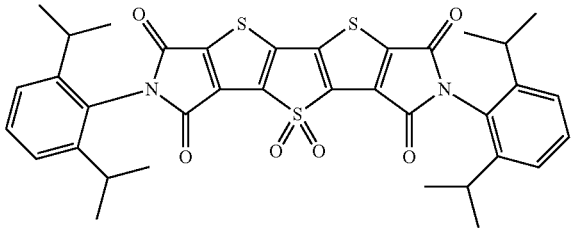

(1-5)

Synthesis of Compound (1-4)

The compound (1-4) was synthesized by the following method. First, the compound (A1-1) (0.34 g, 1.0 mmol) and an acetic acid (30 mL) were added into a flask. Then, the compound (B1-2) (0.41 g, 3.0 mmol) was added into the flask and the flask contents were stirred for three hours at 120 ° C. Then, the compound (B2-1) (0.27 g, 3.0 mmol) represented by chemical formula (B2-1) shown below was added into the flask and the flask contents were stirred for In the reaction (R11), the compound (1-1) (0.065 g, 0.1 mmol) obtained by the above-described method and chloroform (30 mL) were added into a flask. Then, an m-chloroperbenzoic acid (0.52 g, 3.0 mmol) was added into the flask and the flask contents were refluxed while being stirred for 24 hours at 70° C. The internal temperature of the flask was adjusted to room temperature (25° C.) again, and then an aqueous sodium hydrogencarbonate solution was added into the flask to neutralize the flask contents. Thereafter, a chloroform phase was extracted. The chloroform phase was washed with ion exchanged water five times, and then dried using anhydrous sodium sulfate. Thereafter, the solvent was evaporated. The resultant residue was purified by silica gel chromatography using chloroform as a developing solvent. Through the above, the compound (1-5) was obtained. A mass yield and a percentage yield of the compound (1-5) were 0.027 g and 40%, respectively.

Synthesis of Compound (1-6)

The compound (1-6) was synthesized in the same manner as the reaction (R11) in all aspects other than that the compound (1-2) (0.057 g) obtained by the above-described method was used instead of the compound (1-1) (0.065 g) in the reaction (R11). A mass yield and a percentage yield of the compound (1-6) were 0.024 g and 40%, respectively.

Synthesis of Compound (1-7)

The compound (1-7) was synthesized in the same manner as the reaction (R11) in all aspects other than that the compound (1-3) (0.059 g) obtained by the above-described method was used instead of the compound (1-1) (0.065 g) in the reaction (R11). A mass yield and a percentage yield of the compound (1-7) were 0.025 g and 40%, respectively.

Synthesis of Compound (1-8)

The compound (1-8) was synthesized in the same manner as the reaction (R11) in all aspects other than that the compound (1-4) (0.052 g) obtained by the above-described method was used instead of the compound (1-1) (0.065 g) in the reaction (R11). A mass yield and a percentage yield of the compound (1-8) were 0.017 g and 30%, respectively.

Next, a $^1$H-NMR spectrum was measured for each of the synthesized compounds (1-1) to (1-8) using a proton nuclear magnetic resonance spectrometer to determine chemical shift values. $CDCl_3$ was used as a solvent. Tetramethylsilane (TMS) was used as an internal standard sample. Among the compounds (1-1) to (1-8), the compound (1-1) will be described as a representative example. The chemical shift value of the compound (1-1) is shown below.

Compound (1-1): $^1$H-NMR (400 MHz, $CDCl_3$) $\delta$=7.49 (t, 2H), 7.31 (d, 4 H), 2.85 (hept, 4H), 1.22 (d, 24H).

It was confirmed that the compound (1-1) was obtained based on the chemical shift value. Similarly, it was confirmed based on respective chemical shift values thereof that the compounds (1-2) to (1-8) were obtained.

Production of Photosensitive Member

Single-layer photosensitive members (A-1) to (A-16), (B-1), and (B-2), were each produced by a method described below.

Production of Photosensitive Member (A-1)

First, the X-form metal-free phthalocyanine (5 parts by mass) as a charge generating material, the hole transport material (HTM1-1) (80 parts by mass), the compound (1-1) (50 parts by mass) as an electron transport material, and a bisphenol Z polycarbonate resin ("TS2050 " manufactured by Teijin Limited, viscosity average molecular weight: 50,000) (100 parts by mass) as a binder resin were added to tetrahydrofuran (800 parts by mass). These materials (the X-form metal-free phthalocyanine, the hole transport material (HTM1-1), the compound (1-1), and the bisphenol Z polycarbonate resin) and tetrahydrofuran were mixed for 50 hours using a ball mill to disperse the materials in tetrahydrofuran, whereby an application liquid for photosensitive layer formation was obtained. Then, the application liquid for photosensitive layer formation was applied onto a drum-shaped aluminum support (diameter: 30 mm, entire length: 238.5 mm) as a conductive substrate to form an applied film. The applied film was dried at 100° C. for 30 minutes. Thus, a photosensitive layer (film thickness: 30 μm) was formed on the conductive substrate and the photosensitive member (A-1) was obtained. The surface of the obtained photosensitive member (A-1) was visually observed to confirm that the surface was not crystallized.

Production of Photosensitive Members (A-2) to (A-16), (B-1), and (B-2)

Each of the photosensitive members (A- 2) to (A- 16), (B-1), and (B- 2) was produced in the same manner as the photosensitive member (A-1) in all aspects other than the following changes. For each of the obtained photosensitive members (A-2) to (A-16), it was confirmed through the visual observation that the surface of the photosensitive member was not crystallized. By contrast, for each of the photosensitive members (B-1) and (B-2), it was confirmed through the visual observation that the surface of the photosensitive member was slightly crystallized.

Changes

With respect to each of the photosensitive members (A-2) to (A-16), (B-1), and (B-2), a corresponding one of the charge generating materials indicated in Table 1 was used instead of the X-form metal-free phthalocyanine used as the charge generating material in production of the photosensitive member (A-1). With respect to each of the photosensitive members (A-2) to (A-16), (B-1), and (B-2), a corresponding one of the electron transport materials indicated in Table 1 was used instead of the compound (1-1) used as the electron transport material in production of the photosensitive member (A-1). Note that "1-1 ", "1-2 ", "1-3 ", "1-4 ", "1-5 ", "1-6 ", "1-7 ", "1-8 ", and "E-1 " in the column titled "Electron transport material" in Table 1 represent the compounds (1-1), (1-2), (1-3), (1-4), (1-5), (1-6), (1-7), (1-8), and (E-1) respectively.

Evaluation of Sensitivity Characteristics of Photosensitive Member

Sensitivity characteristics were evaluated for each of the photosensitive members (A-1) to (A-16), (B-1), and (B-2). The sensitivity characteristics were evaluated in an environment at a temperature of 23° C. and a relative humidity of 50%. First, the surface of each photosensitive member was charged to +700 V using a drum sensitivity test device (product of Gen-Tech, Inc.). Then monochromatic light (wavelength: 780 nm, half-width: 20 nm, light intensity: 1.5 $\mu J/m^2$) was obtained from white light emitted from a halogen lamp using a bandpass filter. The surface of the photosensitive member was irradiated with the obtained monochromatic light. A surface potential of the photosensitive member was measured when 0.5 seconds elapsed from the start of the irradiation. The measured surface potential was taken to be a post-irradiation electric potential $V_L$ (unit: V). The measured post-irradiation electric potential $V_L$ is indicated in Table 1. A smaller absolute value of the post-irradiation electric potential $V_L$ indicates more excellent sensitivity characteristics of the photosensitive member.

TABLE 1

| | Photosensitive member | Charge generating material | Electron transport material | Post-irradiation electric potential $V_L$ (V) |
|---|---|---|---|---|
| Example 1 | A-1 | X-form metal-free phthalocyanine | 1-1 | +114 |
| Example 2 | A-2 | Y-form titanyl phthalocyanine | 1-1 | +108 |
| Example 3 | A-3 | X-form metal-free phthalocyanine | 1-2 | +112 |
| Example 4 | A-4 | Y-form titanyl phthalocyanine | 1-2 | +107 |
| Example 5 | A-5 | X-form metal-free phthalocyanine | 1-3 | +110 |
| Example 6 | A-6 | Y-form titanyl phthalocyanine | 1-3 | +105 |
| Example 7 | A-7 | X-form metal-free phthalocyanine | 1-4 | +109 |
| Example 8 | A-8 | Y-form titanyl phthalocyanine | 1-4 | +104 |
| Example 9 | A-9 | X-form metal-free phthalocyanine | 1-5 | +113 |
| Example 10 | A-10 | Y-form titanyl phthalocyanine | 1-5 | +107 |
| Example 11 | A-11 | X-form metal-free phthalocyanine | 1-6 | +111 |
| Example 12 | A-12 | Y-form titanyl phthalocyanine | 1-6 | +106 |
| Example 13 | A-13 | X-form metal-free phthalocyanine | 1-7 | +109 |
| Example 14 | A-14 | Y-form titanyl phthalocyanine | 1-7 | +104 |
| Example 15 | A-15 | X-form metal-free phthalocyanine | 1-8 | +108 |
| Example 16 | A-16 | Y-form titanyl phthalocyanine | 1-8 | +103 |
| Comparative example 1 | B-1 | X-form metal-free phthalocyanine | E-1 | +135 |
| Comparative example 2 | B-2 | Y-form titanyl phthalocyanine | E-1 | +130 |

As indicated in Table 1, the photosensitive layer of each of the photosensitive members (A-1) to (A-16) contained any one of the compounds (1-1) to (1-8) represented by general formula (1). The photosensitive members (A-1) to (A-16) each had a post-irradiation electric potential $V_L$ of no greater than +114 V.

As indicated in Table 1, the photosensitive layer of each of the photosensitive members (B-1) and (B-2) contained the compound (E-1), which was not a compound represented by general formula (1). The photosensitive members (B-1) and (B-2) each had a post-irradiation electric potential $V_L$ of at least +130 V.

As is evident from Table 1, the photosensitive members (A-1) to (A-16) were superior to the photosensitive members (B-1) and (B-2) in the sensitivity characteristics.

What is claimed is:

1. An electrophotographic photosensitive member comprising a conductive substrate and a photosensitive layer, wherein the photosensitive layer has a single-layer structure and contains a charge generating material and a compound represented by a general formula (1) shown below, (1)

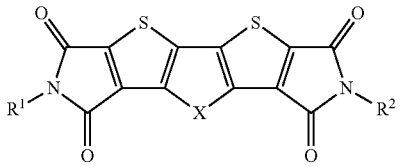

where in the general formula (1), $R^1$ and $R^2$ each represent, independently of each other: an alkyl group having a carbon number of at least 1 and no greater than 12 and optionally substituted by an alkoxy group having a carbon number of at least 1 and no greater than 6 or an alkoxycarbonyl group having a carbon number of at least 2 and no greater than 6; an aryl group having a carbon number of at least 6 and no greater than 14 and optionally substituted by an alkyl group having a carbon number of at least 1 and no greater than 6; an aralkyl group having a carbon number of at least 7 and no greater than 20; or a cycloalkyl group having a carbon number of at least 3 and no greater than 10, and X represents —S— or —$SO_2$—.

2. The electrophotographic photosensitive member according to claim 1, wherein in the general formula (1), $R^1$ and $R^2$ each represent, independently of each other: an alkyl group having a carbon number of at least 1 and no greater than 12 and substituted by an alkoxy group having a carbon number of at least 1 and no greater than 6 or an alkoxycarbonyl group having a carbon number of at least 2 and no greater than 6; or an aryl group having a carbon number of at least 6 and no greater than 14 and substituted by an alkyl group having a carbon number of at least 1 and no greater than 6.

3. The electrophotographic photosensitive member according to claim 2, wherein in the general formula (1), at least one of $R^1$ and $R^2$ represents an alkyl group having a carbon number of at least 1 and no greater than 12 and substituted by an alkoxy group having a carbon number of at least 1 and no greater than 6 or an alkoxycarbonyl group having a carbon number of at least 2 and no greater than 6.

4. The electrophotographic photosensitive member according to claim 1, wherein in the general formula (1), X represents —$SO_2$—.

5. The electrophotographic photosensitive member according to claim 2, wherein the compound represented by the general formula (1) is a compound represented by a chemical formula (1-1), (1-2), (1-3), (1-4), (1-5), (1-6), (1-7), or (1-8) shown below (1-1)

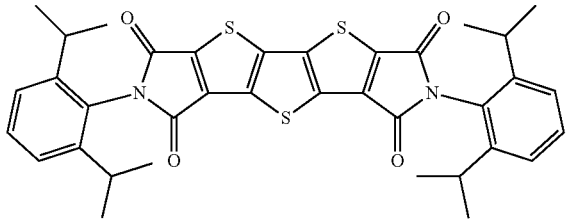

-continued (1-2)

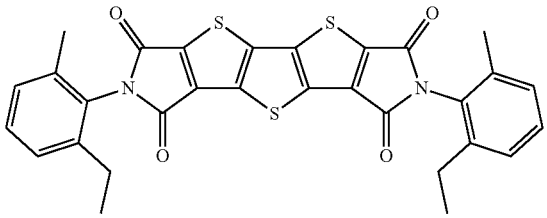

(1-3)

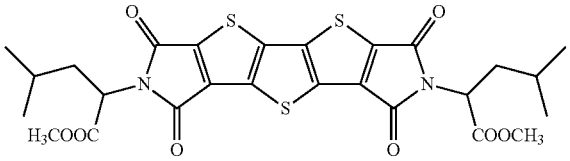

(1-4)

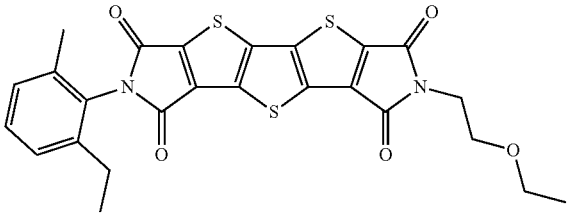

(1-5)

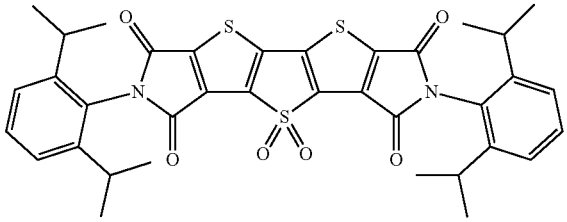

(1-6)

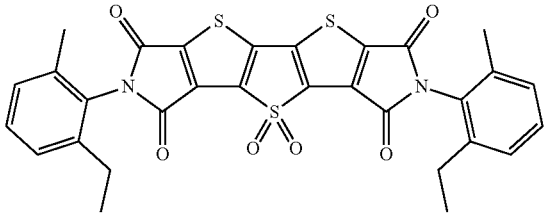

(1-7)

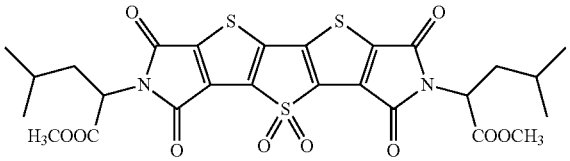

(1-8)

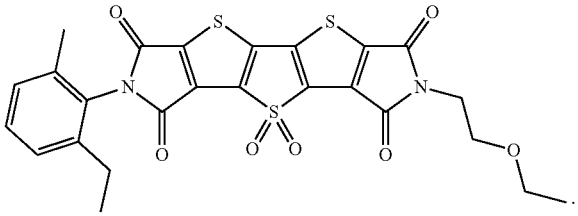

6. The electrophotographic photosensitive member according to claim 1, wherein the charge generating material includes an X-form metal-free phthalocyanine, a Y-form titanyl phthalocyanine, or a combination thereof.

7. The electrophotographic photosensitive member according to claim 1, wherein the photosensitive layer further contains a hole transport material, and the hole transport material includes a compound represented by a general formula (HTM1) shown below, (HTM1)

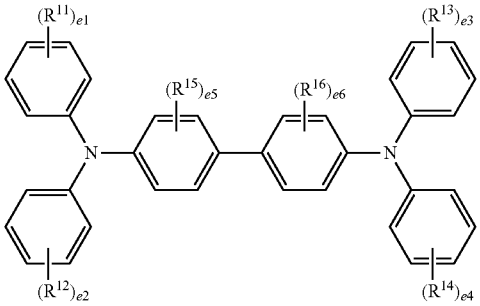

where in the general formula (HTM1), $R^{11}$, $R^{12}$, $R^{13}$, $R^{14}$, $R^{15}$, and $R^{16}$ each represent, independently of one another, an alkyl group having a carbon number of at least 1 and no greater than 4, e1, e2, e3, and e4 each represent, independently of one another, an integer of at least 0 and no greater than 5, e5 and e6 each represent, independently of each other, an integer of at least 0 and no greater than 4, when e1 represents an integer of at least 2 and no greater than 5, a plurality of chemical groups $R^{11}$ may be the same as or different from each other, when e2 represents an integer of at least 2 and no greater than 5, a plurality of chemical groups $R^{12}$ may be the same as or different from each other, when e3 represents an integer of at least 2 and no greater than 5, a plurality of chemical groups $R^{13}$ may be the same as or different from each other, when e4 represents an integer of at least 2 and no greater than 5, a plurality of chemical groups $R^{14}$ may be the same as or different from each other, when e5 represents an integer of at least 2 and no greater than 4, a plurality of chemical groups $R^{15}$ may be the same as or different from each other, and when e6 represents an integer of at least 2 and no greater than 4, a plurality of chemical groups le may be the same as or different from each other.

8. The electrophotographic photosensitive member according to claim 7, wherein the hole transport material includes a compound represented by a chemical formula (HTM1-1) shown below (HTM1-1)
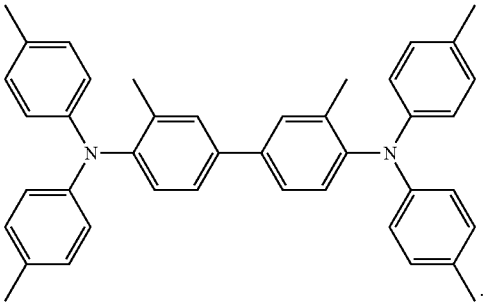
* * * * *